US010854161B2

(12) United States Patent
Kim et al.

(10) Patent No.: US 10,854,161 B2
(45) Date of Patent: Dec. 1, 2020

(54) DISPLAY DEVICE AND METHOD OF DETECTING DEFECT OF THE SAME

(71) Applicant: Samsung Display Co., Ltd., Yongin-Si (KR)

(72) Inventors: Yunmi Kim, Changwon-si (KR); Kihyun Pyun, Gwangmyeong-si (KR); Sung-In Kang, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/186,944

(22) Filed: Nov. 12, 2018

(65) Prior Publication Data

US 2019/0156783 A1 May 23, 2019

(30) Foreign Application Priority Data

Nov. 17, 2017 (KR) ..... 10-2017-0154323

(51) Int. Cl.
*G09G 3/36* (2006.01)
*G09G 5/14* (2006.01)
*G09G 3/20* (2006.01)

(52) U.S. Cl.
CPC ..... *G09G 3/3685* (2013.01); *G09G 3/20* (2013.01); *G09G 3/3674* (2013.01); *G09G 5/14* (2013.01); *G09G 2310/0243* (2013.01); *G09G 2310/08* (2013.01); *G09G 2330/12* (2013.01)

(58) Field of Classification Search
CPC ..... G09G 3/3685
See application file for complete search history.

(56) References Cited

U.S. PATENT DOCUMENTS 5,081,687 A * 1/1992 Henley ..... G01R 31/316 345/87
6,816,143 B1 * 11/2004 Lambert ..... G09G 3/3688 345/100
7,145,539 B2 * 12/2006 Lim ..... G09G 3/006 345/98
2010/0214316 A1 * 8/2010 Kim ..... G09G 3/3611 345/618
2011/0234574 A1 * 9/2011 Tanaka ..... G09G 3/2096 345/211

FOREIGN PATENT DOCUMENTS

KR 100471782 B1 8/2005

* cited by examiner

*Primary Examiner* — Phi Hoang
(74) *Attorney, Agent, or Firm* — Cantor Colburn LLP

(57) ABSTRACT

A display device includes a display panel divided into a first display area and a second display area in a first direction, a first data driver which provides a first data signal to the first display area through data lines arranged in a second direction crossing the first direction, a second data driver which provides a second data signal to the second display area through the data lines arranged in the second direction, a gate driver which provides a gate signal to the display panel through gate lines arranged in the first direction, a timing controller which generates control signals that control the first data driver, the second data driver, and the gate driver, and a defect detector which controls to display a defect detecting image and a reference image on the first display area and the second display area alternately based on an enable signal.

20 Claims, 12 Drawing Sheets

| OUT / EN | OUT_P | OUT_N | IMAGE |
|---|---|---|---|
| 1ST LEVEL | S_P | S_N | DEFECT DETECTING IMAGE |
| 2ND LEVEL | 2ND LEVEL | 1ST LEVEL | REFERENCE IMAGE |

DISPLAY DEVICE AND METHOD OF DETECTING DEFECT OF THE SAME

This application claims priority to Korean Patent Application No. 10-2017-0154323, filed on Nov. 17, 2017, and all the benefits accruing therefrom under 35 U.S.C. § 119, the content of which in its entirety is herein incorporated by reference.

BACKGROUND

1. Technical Field

Exemplary embodiments relate generally to a display device. More particularly, exemplary embodiments of the inventive concept relate to a display device and a method of detecting defect of the same.

2. Description of the Related Art

A liquid crystal display panel of a liquid crystal display device includes a lower substrate, an upper substrate, and a liquid crystal layer interposed between the lower substrate and the upper substrate.

The lower substrate includes a first base substrate, a gate and a data line disposed on the first based substrate, a switching element electrically coupled to the gate line and the data line, and a pixel electrode electrically coupled to the switching element.

The upper substrate includes a second base substrate facing the first substrate, a color filter disposed on the second base substrate, and a common electrode formed on the color filter.

The liquid crystal layer includes a liquid crystal of which an arrangement is changed according to an electric field due to a pixel voltage applied to the pixel electrode and a common voltage applied to the common electrode.

Recently, a dual driving method that provides data signals from both ends of data line as a size of the liquid crystal display device increases.

SUMMARY

Some exemplary embodiments provide a display device capable of detecting defect of a data driver.

Some exemplary embodiments provide a method of detecting a defect of the display device capable of detecting defect of a data driver.

According to an aspect of exemplary embodiments, a display device includes a display panel divided into a first display area and a second display area in a first direction, a first data driver which provides a first data signal to the first display area through data lines arranged in a second direction crossing the first direction, a second data driver which provides a second data signal to the second display area through the data lines arranged in the second direction, a gate driver which provides a gate signal to the display panel through gate lines arranged in the first direction, a timing controller which generates control signals that control the first data driver, the second data driver, and the gate driver, and a defect detector which controls to display a defect detecting image and a reference image on the first display area and the second display area alternately based on an enable signal.

In some exemplary embodiments, the timing controller may provide defect detecting image data corresponding to the defect detecting image to the defect detector, and the defect detector may provide the defect detecting image data or reference image data corresponding to the reference image to the first data driver or the second data driver based on the enable signal.

In some exemplary embodiments, the defect detector may include a first defect detector which provides defect detecting image data corresponding to the defect detecting image or reference image data corresponding to the reference image to the first data driver based on a first enable signal, and a second defect detector which provides the defect image data or the reference image data to the second data driver based on a second enable signal.

In some exemplary embodiments, the first defect detector may control to display the defect detecting image on the first display area for detecting the defect of the first data driver, and the second defect detector may control to display the defect detecting image on the second display area for detecting the defect of the second data driver.

In some exemplary embodiments, the first defect detector may provide the defect detecting image data to the first data driver when the first enable signal having a first level is provided, and provide the reference image data to the first data driver when the first enable signal having a second level is provided.

In some exemplary embodiments, the second defect detector may provide the defect detecting image data to the second data driver when the second enable signal having a first level is provided, and may provide the reference image data to the second data driver when the second enable signal having a second level is provided.

In some exemplary embodiments, the defect detecting image may be displayed on the first display area when the first enable signal having a first level is provided to the first defect detector, and the reference image may be displayed on the first display area when the first enable signal having a second level is provided to the first defect detector.

In some exemplary embodiments, the defect detecting image may be displayed on the second display area when the second enable signal having a first level is provided to the second defect detector, and the reference image may be displayed on the second display area when the second enable signal having a second level is provided to the second defect detector.

In some exemplary embodiments, the first enable signal having a first level may be provided to the first defect detector and the second enable signal having a second level may be provided to the second defect detector in order to detect the defect of the first data driver.

In some exemplary embodiments, the first enable signal having a second level may be provided to the first defect detector and the second enable signal having a first level may be provided to the second defect detector in order to detect the defect of the second data driver.

In some exemplary embodiments, the defect detecting image data may be a differential signal that includes a positive signal and a negative signal.

In some exemplary embodiments, each of the first defect detector and the second defect detector may include a first AND gate which performs a logical conjunction of the positive signal and a corresponding enable signal of the first and second enable signals, a second AND gate which performs a logical conjunction of the negative signal and the corresponding enable signal of the first and second enable signals, and a NOT gate which inverses an output of the second AND gate.

In exemplary embodiments, each of the first defect detector and the second defect detector may include a first multiplexer which outputs one of the positive signal and a first voltage based on a corresponding enable signal of the first and second enable signals and a second multiplexer which outputs one of the negative signal and a second voltage.

In exemplary embodiments, the reference image may be a black color image.

According to an aspect of exemplary embodiments, a method of detecting defect of a display device includes displaying a defect detecting image on a first display area of a display panel and a reference image on a second display area of the display panel, wherein the display panel is divided into the first display area and the second display area in a first direction, detecting a defect of a first data driver coupled to the first display area, displaying the reference image on the first display area and the defect detecting image on the second display area, and detecting a defect of a second data driver coupled to the second display area.

In some exemplary embodiments, displaying the defect detecting image on the first display area and the reference image on the second display area may include providing a first enable signal having a first level to a first defect detector coupled to the first data driver that provides a data signal to the first display area, and providing a second enable signal having a second level to a second defect detector coupled to the second data driver that provides a data signal to the second display area.

In some exemplary embodiments, displaying the reference image on the first display area and the defect detecting image on the second display area may include providing a first enable signal having a second level to a first defect detector coupled to the first data driver that provides a data signal to the first display area and providing a second enable signal having a first level to a second defect detector coupled to the second data driver that provides a data signal to the second display area.

According to an aspect of exemplary embodiments, a display device includes a display panel which includes a first display area and a second display area, and a defect detector which controls to display a defect detecting image or a reference image on the first display area based on a first enable signal and display a defect detecting image or a reference image on the second display area based on a second enable signal. The reference image is displayed on the second display area when the defect detecting image is displayed on the first display area, and the defect detecting image may be displayed on the second display area when the reference image is displayed on the first display area.

In some exemplary embodiments, the defect detector may include a first defect detector which provides defect detecting image data corresponding to the defect detecting image or reference image data corresponding to the reference image to a first data driver that provides a data signal to the first display area, and a second defect detector which provides the defect detecting image data or the reference image data to a second data driver that provides a data signal to the second display area.

In some exemplary embodiments, the first defect detector may provide the defect detecting image data to the first data driver when the first enable signal having a first level is provided and provide the reference image data to the first data driver when the first enable signal having a second level is provided, and the second defect detector may provide the defect detecting image data to the second data driver when the second enable signal having the first level is provided and provide the reference image data to the second data driver when the second enable signal having the second level is provided.

Therefore, a display device and a method of detecting defect of the same may detect defects of the first data driver coupled to the first display area and the second data driver coupled to the second display area respectively by alternately displaying the defect detecting image and the reference image on the first display area and the second display area of the display panel.

BRIEF DESCRIPTION OF THE DRAWINGS

Illustrative, non-limiting exemplary embodiments will be more clearly understood from the following detailed description taken in conjunction with the accompanying drawings. It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

DETAILED DESCRIPTION

Hereinafter, the inventive concept will be explained in detail with reference to the accompanying drawings.

Figure 1:
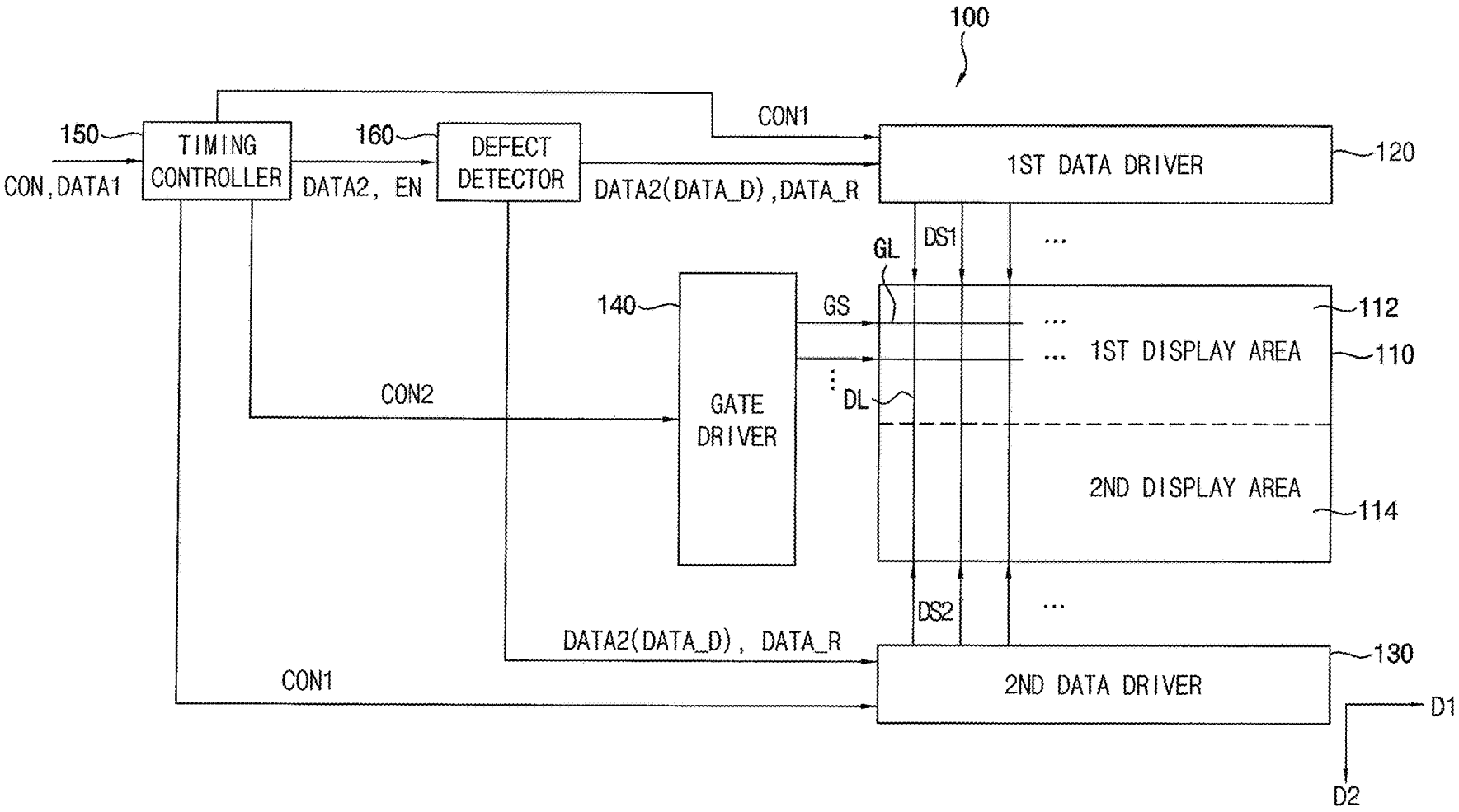
FIG. 1 is a block diagram illustrating an exemplary embodiment of a display device according to the invention.

FIG. 1 is a block diagram illustrating an exemplary embodiment of a display device according to the invention.

Referring to FIG. 1, a display device 100 may include a display panel 110, a first data driver 120, a second data driver 130, a gate driver 140, a timing controller 150, and a defect detector 160.

The display panel 110 may include data lines DL, gate lines GL, and a plurality of pixels. The gate lines GL may extend in a first direction D1 and be arranged in a second direction D2 substantially perpendicular to the first direction D1. The data lines DL may extend to the second direction D2 and be arranged in the first direction D1. The first direction D1 may be parallel with a long side of the display panel 110, and the second direction D2 may be parallel with a short side of the display panel 110. Each of the pixels may be arranged in an intersection region of the data line DL and the gate line GL. Each of the pixels may include a thin film transistor electrically coupled to one of the gate lines GL and one of the data lines DL, a liquid crystal capacitor and a storage capacitor coupled to the thin film transistor. Thus, the display panel 110 may be a liquid crystal panel, and the display device 100 may be a liquid crystal display device.

A dual driving method that includes first and second data drivers 120 and 130 in both ends (up and down, or left side and right side) of the display panel 110 provides a data signal to both ends of the data line DL in order to obtain a charging rate of the pixel.

The display panel 110 of the display device 100 according to exemplary embodiments may include a first display area 112 and a second display area 114. The display panel 110 may be divided into the first display area 112 and the second display area 114 in the first direction D1. That is the display panel 110 may be divided into the first display area 112 and the second display area 114 by a line therebetween extending in the first direction D1 as shown in FIG. 1. A first data signal DS1 from the first data driver 120 may be provided to the first display area 112 through the data lines DL. A second data signal DS2 from the second data driver 130 may be provided to the second display area 114 through the data lines DL. Here, the data lines DL in the first area 112 and the data lines DL in the second display area 114 may be coupled.

The first data driver 120 may provide the first data signal DS1 to the first display area 112 through the data lines DL arranged in the second direction D2. The first data driver 120 may receive a first control signal CON1 from the timing controller 150. In an exemplary embodiment, for example, the first control signal CON1 may include a horizontal start signal and a first clock signal. The first data driver 120 may convert the image data provided from the defect detector 160 to the first data signals DS1 that are analog signals. The first data driver 120 may output the first data signals DS1 to the data lines DL.

The second data driver 130 may provide the second data signal DS2 to the second display area 114 through the data lines DL arranged in the second direction D2. The second data driver 130 may receive the first control signal CON1 from the timing controller 150. In an exemplary embodiment, for example, the first control signal CON1 may include the horizontal start signal and the first clock signal. The second data driver 130 may convert the image data provided from the defect detector 160 to the second data signals DS2 that are the analog signals. The second data driver 130 may output the second data signals DS2 to the data lines DL.

The first data driver 120 and the second data driver 130 may be directly mounted on the display panel 110 or coupled to the display panel 110 by being implemented as a tape carrier package ("TCP").

The gate driver 140 may provide gate signals GS to the display panel 110 through the gate lines GL arranged in the first direction D1. The gate driver 140 may receive a second control signal CON2 from the timing controller 150. In an exemplary embodiment, for example, the second control signal CON2 may include a vertical start signal and a second clock signal. The gate driver 140 may generate the gate signals GS in order to drive the pixels based on the second control signal CON2. The gate driver 140 may output the gate signals GS to the gate lines GL.

The gate driver 140 may be directly mounted on the display panel 110 or coupled to the display panel 110 by being implemented as the TCP. Alternatively, the gate driver 140 may be directly integrated on a peripheral area of the display panel 110.

The timing controller 150 may generate the first control signal CON1 and the second control signal CON2 that control the first data driver 120, the second data driver 130, and the gate driver 140. The timing controller 150 may receive a first image data DATA1 and an input control signal CON from an external device. The first image data DATA1 may be RGB data (i.e., red data, green data, and blue data). The timing controller 150 may provide the second image data DATA2 to the defect detector 160. Here, the second image data DATA2 may be substantially the same with the first image data DATA1 or may be an image data compensated from the first image data DATA1. In an exemplary embodiment, for example, the timing controller 150 may generate the second image data DATA2 by selectively performing a display quality compensation, an adaptive color correction ("ACC"), a dynamic capacitance compensation ("DCC"), etc. to the first image data DATA1. The timing controller 150 may provide the second image data DATA2 corresponding to a display image that will be displayed on the display panel 110 to the defect detector 160. In a defect detecting mode, the timing controller 150 may provide the second image data DATA2 corresponding to a defect detecting image to the defect detector 160. Here, the defect detecting image may be a predetermined test image for detecting defects in the first display area 112 or the second display area 114. In an exemplary embodiment, for example, the defect detecting image may be a RGB image (i.e., a red image, a green image, and a blue image). The defects of the first data driver 120 or the second data driver 130 may be detected using each of the defect detecting images.

The control signal CON may include a horizontal sync signal, a vertical sync signal, and a clock signal. The timing controller 150 may generate the horizontal start signal based on the horizontal sync signal, and the first clock signal based on the clock signal. The timing controller 150 may provide the horizontal start signal and the first clock signal to the first data driver 120 and the second data driver 130 as the first control signal CON1. Further, the timing controller 150 may generate the vertical start signal based on the vertical sync signal, and the second clock signal based on the clock signal. The timing controller 150 may provide the vertical start signal and the second clock signal to the gate driver 140 as the second control signal CON2.

The defect detector 160 may provide the image data such that the image is displayed on the first display area 112 and the second display area 114 based on an enable signal EN. The defect detector 160 may provide the second image data DATA2 received from the timing controller 150 to the first data driver 120 and the second data driver 130 when the enable signal EN having a first level is provided to the defect detector 160. The defect detector 160 may provide a reference image data DATA_R corresponding to a reference image to the first data driver 120 and the second data driver 130 when the enable signal EN having a second level is provided to the defect detector 160. In an exemplary embodiment, for example, the first level may be a voltage lower than the second level. In the defect detecting mode, defect detecting image data DATA_D corresponding to the defect detecting image may be provided to the defect detector 160 as the second image data DATA2 from the timing controller 150.

The defect detector 160 may provide image data such that the defect detecting image and the reference image are displayed alternately on the first display area 112 and the second display area 114 based on the enable signal EN and detect the defect of the first data driver 120 or the second data driver 130 based on the defect detecting image. In the case that both the first data signal DS1 provided from the first data driver 120 and the second data signal DS2 provided from the second data driver 130 are provided through the data line DL of the display panel 110 and the defect occurs to one of the first data driver 120 and the second data driver 130, it is difficult to detect existence of the defect because the data driver to which the defect doesn't occur still provide the data signal to the data line DL. On the other hand, the display device 100 according to exemplary embodiments may detect the defects of the first data driver 120 and the second data driver respectively by alternately displaying the defect detecting image and the reference image on each of the first display area 112 that receives the first data signal DS1 from the first data driver 120 and the second display area 114 that receives the second data signal DS2 from the second data driver 130. Here, the reference image may be an image that allows the defect to be easily detected on the defect detecting image. In some exemplary embodiments, the reference image may be a black color image.

The defect detecting image data DATA_D corresponding to the defect detecting image from the timing controller 150 may be provided to the defect detector 160 as the second image data DATA2. Further, the defect detector 160 may receive the enable signal EN form the timing controller 150. The defect detector 160 may provide the defect detecting image data DATA_D or the reference image data DATA_R to the first data driver 120 or the second data driver 130 based on the enable signal EN. Specifically, the defect detector 160 may provide the defect detecting image data DATA_D to the first data driver 120 and provide the reference image data DATA_R to the second data driver 130. In this case, the defect detecting image may be displayed on the first display area 112 and the reference image may be displayed on the second display area 114. Thus, the defect on the first display area 112 may be detected. Further, the defect detector 160 may provide the reference image data DATA_R to the first data driver 120 and provide the defect detecting image DATA_D to the second data driver 130. In this case, the reference image may be displayed on the first display area 112 and the defect detecting image may be displayed on the second display area 114. Thus, the defect on the second display area 114 may be detected.

Although the defect detector 160 coupled to the timing controller 150 is described in FIG. 1, the defect detector 160 may be located in the timing controller 150 in another exemplary embodiment. Further, the enable signal EN provided from the timing controller 150 is described in FIG. 1. However, the enable signal EN may be provided to the defect detector 160 from an external device in another exemplary embodiment.

As described above, the display device 110 of FIG. 1 may detect the defects of the first data driver 120 coupled to the first display area 112 and the second data driver 130 coupled to the second display area 114 respectively by the defect detector 160 that alternately display the defect detecting image and the reference image on the first display area 112 and the second display area 114.

Figure 2A:
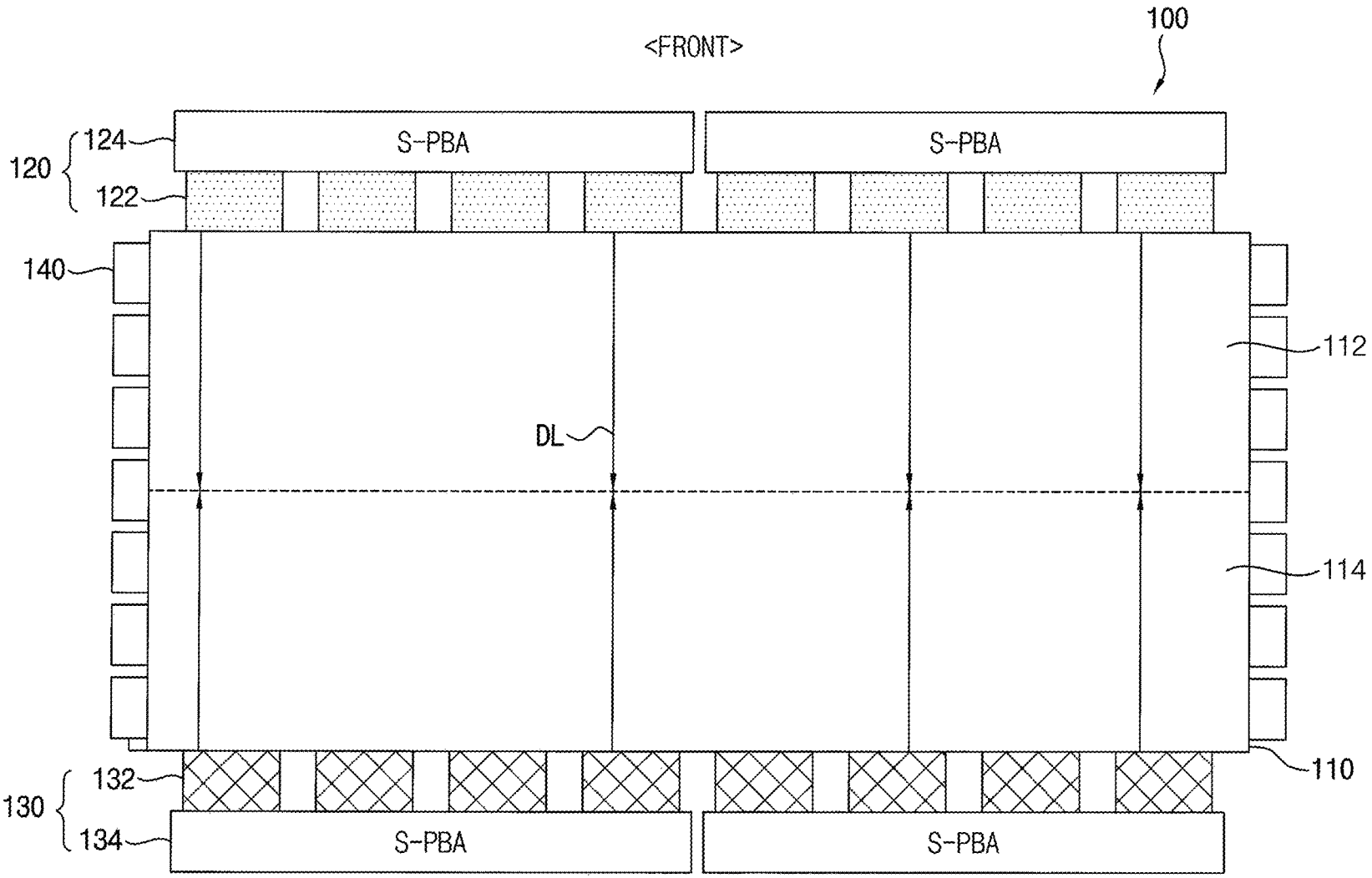
FIGS. 2A and 2B are diagrams illustrating an exemplary embodiment of a display device of FIG. 1.
Figure 2B:
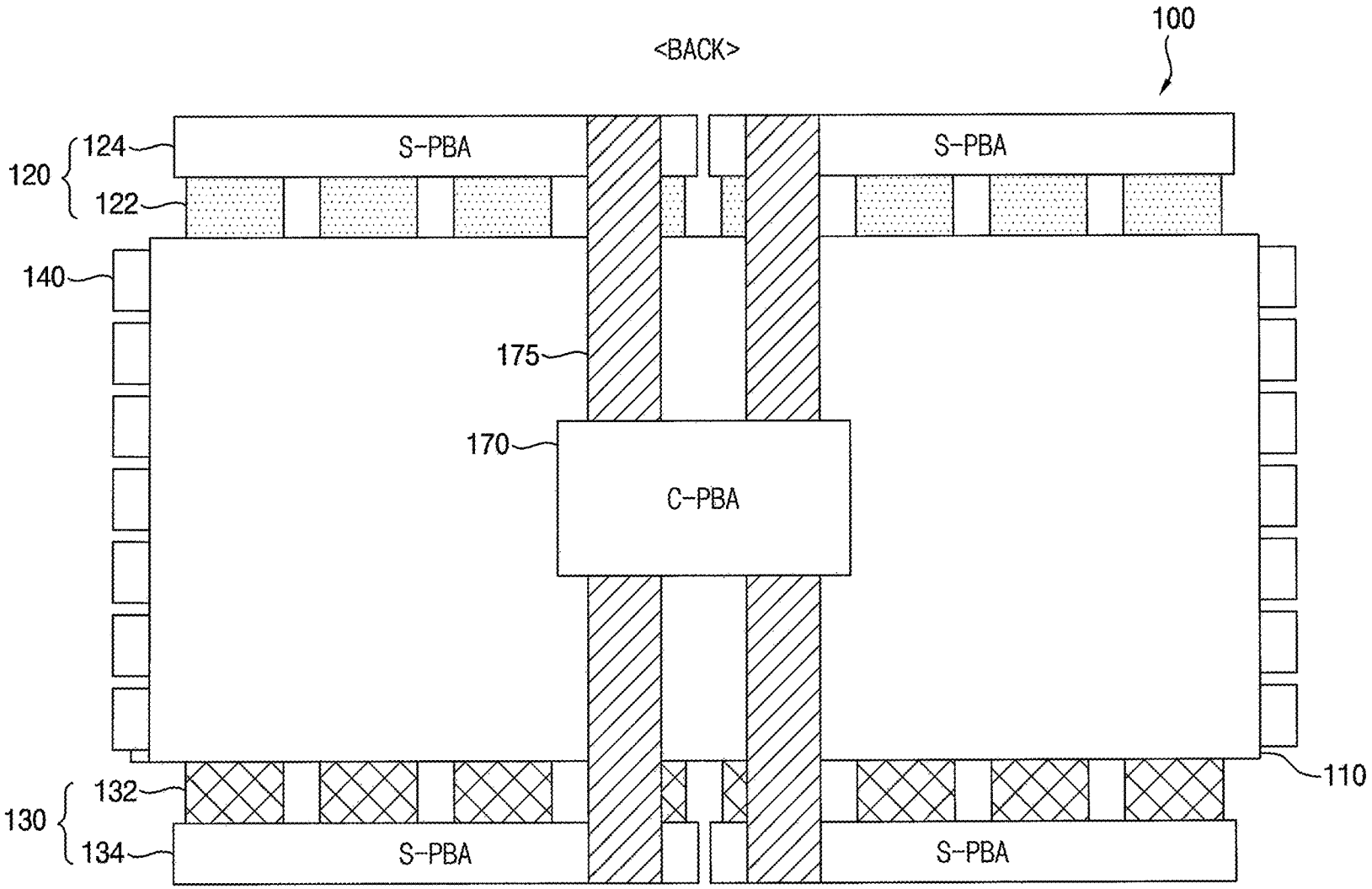
Figure 3A:
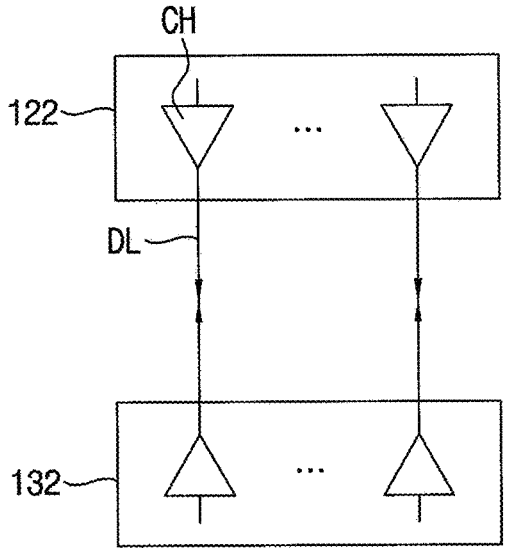
FIGS. 3A and 3B are diagrams illustrating exemplary embodiments of a source driving integrated circuit included in the display device of FIGS. 2A and 2B.
Figure 3B:
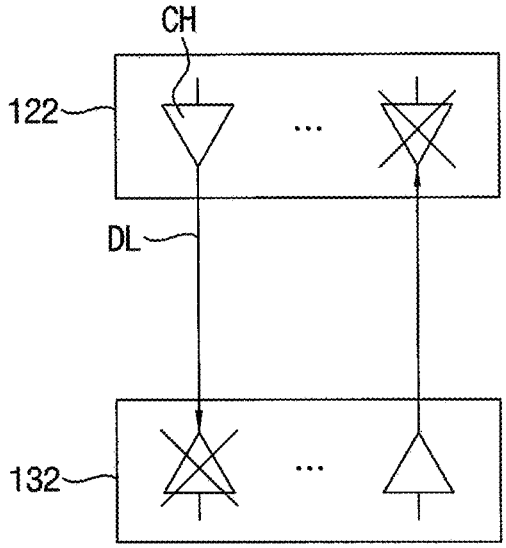

FIGS. 2A and 2B are diagrams illustrating an exemplary embodiment of a display device of FIG. 1, and FIGS. 3A and 3B are diagrams illustrating exemplary embodiments of a source driving integrated circuit included in the display device of FIGS. 2A and 2B.

FIG. 2A is a diagram illustrating a front of the display device. FIG. 2B is a diagram illustrating a back of the display device. Referring to FIGS. 2A and 2B, the display device 100 may include the display panel 110, a first data driver 120, a second data driver 130, a gate driver 140, a control driver 170, and a connecting member 175.

A plurality of data lines DL may be disposed on the display panel 110. The display panel 110 may include the first display area 112 and the second display area 114. The data lines DL of the first display area 112 may receive the data signal from upper side of the display panel 110 and the data lines DL of the second display area 114 may receive the data signal from lower side of the display panel 110.

The first data driver 120 may include a plurality of first source driving integrated circuits 122 and first source connecting circuits 124. The first data driver 120 of FIGS. 2A and 2B may correspond to the first data driver 120 of FIG. 1. The first source driving integrated circuits 122 may be implemented as a package that an integrated circuit ("IC") is mounted on the tape and be coupled to the display panel 110. Each of the first source driving integrated circuits 122 may be coupled to some of the data lines DL of the display panel 110 and may provide the data signal to the first display area 112 through the data lines DL. The first source connecting circuits 124 may transfer the first control signal and the second image data provided from the timing controller or the defect detector to the first source driving integrated circuits 122. The first source connecting circuits 124 may be implemented as a printed circuit board ("PCB").

The second data driver 130 may include a plurality of second source driving integrated circuits 132 and second source connecting circuits 134. The second data driver 130 of FIGS. 2A and 2B may correspond to the second data driver 130 of FIG. 1. The second source driving integrated circuit 132 may be implemented as a package that an IC is mounted on the tape and be coupled to the display panel 110. Each of the second source driving integrated circuits 132 may be coupled to some of the data lines DL of the display panel 110 and may provide the data signals to the second display area 114 through the data lines DL. The second source connecting circuits 134 may transfer the first control signal and the second image data provided from the timing controller or the defect detector to the second source driving integrated circuits 132. The second source connecting circuits 134 may be implemented as the PCB.

Referring to FIGS. 3A and 3B, each of the first source driving integrated circuit 122 and the second source driving integrated circuit 132 may include a plurality of channels CH. Each of the channels CH may output the data signal to the data line DL. The first source driving integrated circuit 122 may provide the data signal to the first display area 112 through the data line DL and the second source driving integrated circuit 132 may provide the data signal to the second display area 114 through the data line DL when the first source driving integrated circuit 122 and the second source driving integrated circuit 132 are normally driven as described in FIG. 3A.

The second source driving integrated circuit 132 may provide the data signal to the first display area 112 when one of the channels CH in the first source driving integrated circuit 122 is abnormally driven (i.e., the defect occurs) as described in FIG. 3B. In this case, load of the second source driving integrated circuit 132 may increase, and problems such as lifetime reduction and heat of the second source driving integrated circuit 132 may occur. The first source driving integrated circuit 122 may provide the data signal to the second display area when one of the channels CH in the second source driving integrated circuit 132 is abnormally driven (i.e., the defect occurs). In this case, load of the first source driving integrated circuit 122 may increase, and the problems such as the lifetime reduction and the heat of the first source driving integrated circuit 122 may occur.

The gate driver 140 may be implemented as the tape carrier package and be coupled to the display panel 110. Alternatively, the gate driver 140 may be mounted on the display panel 110.

The control driver 170 may be disposed on the back of the display device 100. The control driver 170 may include the timing controller 150 and the defect detector 160 of FIG. 1. In an exemplary embodiment, for example, the timing controller 150 and the defect detector 160 are implemented as chips mounted on the PCB.

The control driver 170 may be coupled to the first data driver 120 and the second data driver 130 through the connecting member 175. The connecting member 175 may be implemented as a flexible circuit film.

Figure 4:
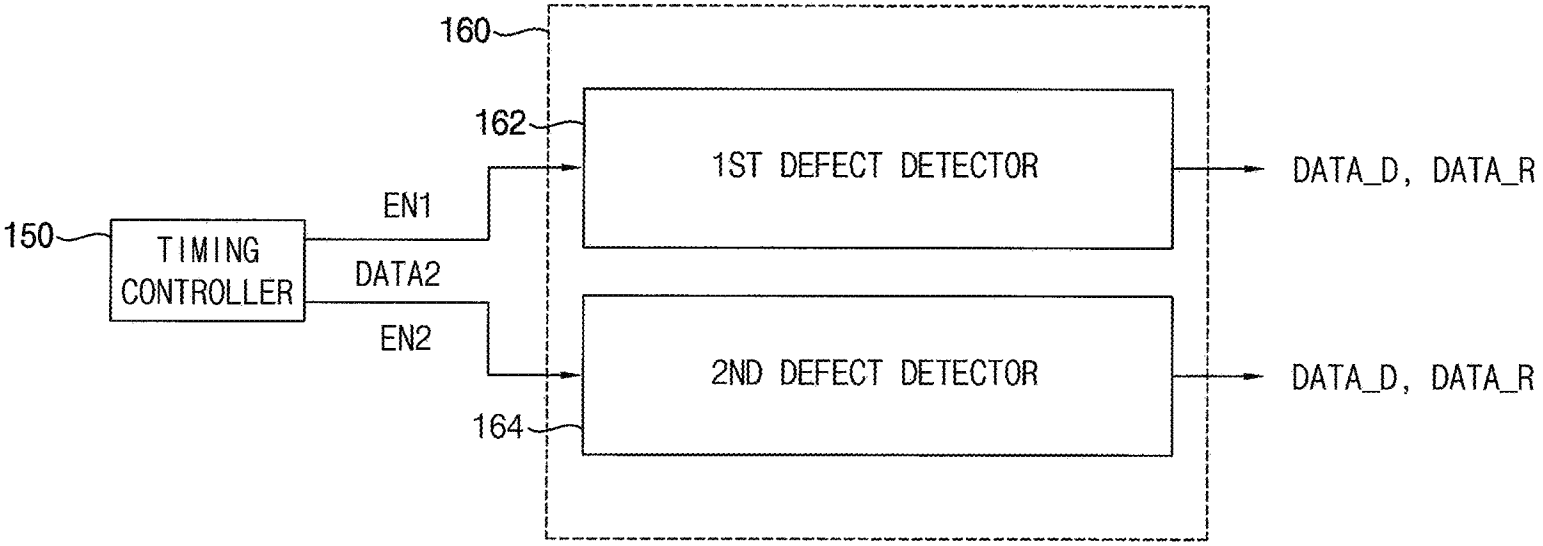
FIG. 4 is a block diagram illustrating an exemplary embodiment of a defect detector included in the display device of FIG. 1.

FIG. 4 is a block diagram illustrating an exemplary embodiment of a defect detector included in the display device of FIG. 1.

Referring to FIG. 4, the defect detector 160 may include a first defect detector 162 and a second defect detector 164.

The first defect detector 162 may provide the defect detecting image data DATA_D corresponding to the defect detecting image or the reference image data DATA_R corresponding to the reference image to the first data driver 120 based on the first enable signal EN1. The first defect detector 162 may receive the first enable signal EN1 and the second image data DATA2 from the timing controller 150. The second image data DATA2 may be the defect detecting data DATA_D in the defect detecting mode. The first defect detector 162 may provide the defect detecting image data DATA_D to the first data driver 120 when the first enable signal EN1 having the first level is provided to the first defect detector 162. In this case, the defect detecting image may be displayed on the first display area 112. The first defect detector 162 may provide the reference image data DATA_R to the first data driver 120 when the first enable signal EN1 having the second level is provided to the first defect detector 162. In this case, the reference image may be displayed on the first display area 112.

The second defect detector 164 may provide the defect detecting image data DATA_D corresponding to the defect detecting image or the reference image data DATA_R corresponding to the reference image to the second data driver 130 based on the second enable signal EN2. The second defect detector 164 may receive the second enable signal EN2 and the second image data DATA2 from the timing controller 150. The second image data DATA2 may be the defect detecting data DATA_D in the defect detecting mode. The second defect detector 164 may provide the defect detecting image data DATA_D to the second data driver 130 when the second enable signal EN2 having the first level is provided to the second defect detector 164. In this case, the defect detecting image may be displayed on the second display area 114. The second defect detector 164 may provide the reference image data DATA_R to the second data driver 130 when the second enable signal EN2 having the second level is provided to the second defect detector 164. In this case, the reference image may be displayed on the second display area 114.

The first enable signal EN1 having the first level may be provided to the first defect detector 162 and the second enable signal EN2 having the second level may be provided to the second defect detector 164 in the defect detecting mode of the first display area 112.

The first enable signal EN1 having the second level may be provided to the first defect detector 162 and the second enable signal EN2 having the first level may be provided to the second defect detector 164 in the defect detecting mode of the second display area 114.

Figure 5A:
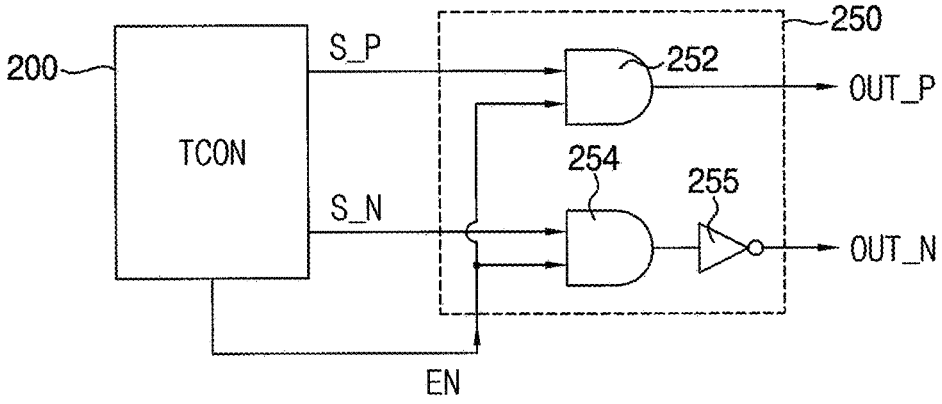
FIG. 5A is a diagram illustrating an exemplary embodiment of the defect detector of FIG. 4.
Figure 5B:
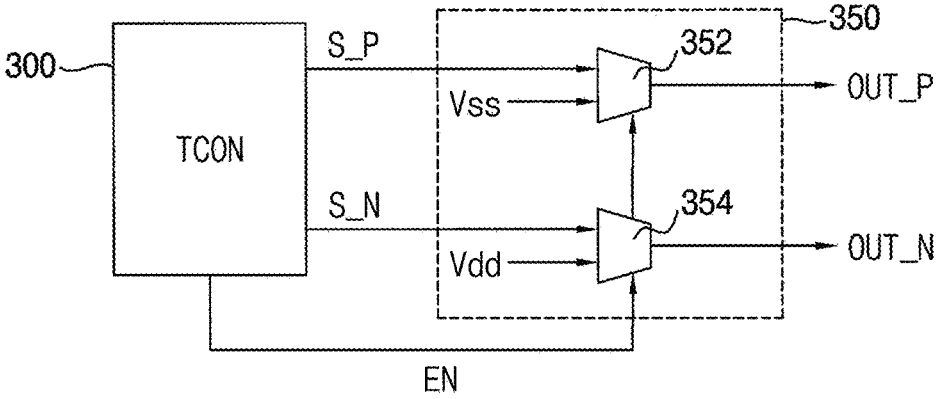
FIG. 5B is a diagram illustrating another exemplary embodiment of the defect detector of FIG. 4.
Figures 5C, 6:
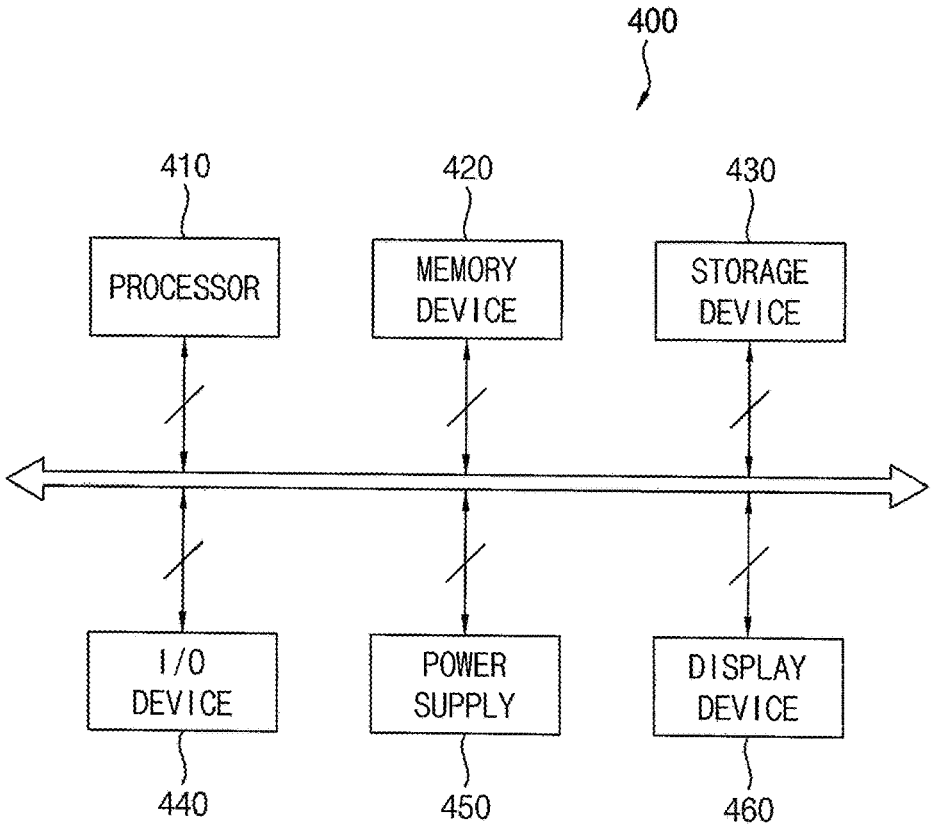
FIG. 5C is a table for describing an operation of the defect detector of FIG. 4.
FIG. 6 is a block diagram illustrating an electronic device that includes the display device of FIG. 1.

FIG. 5A is a diagram illustrating an exemplary embodiment of the defect detector of FIG. 4, FIG. 5B is a diagram illustrating another exemplary embodiment of the defect detector of FIG. 4, and FIG. 5C is a table for describing an operation of the defect detector of FIG. 4.

The defect detecting image data provided to the defect detector from the timing controller may be a differential signal that includes a positive signal and a negative signal since the display device uses a differential interface such as mini-LVDS, RSDS, AiPi, USI-T, etc. in a signal process between the timing controller and the data driver.

Referring to FIG. 5A, the timing controller 200 may provide the differential signal that includes the positive signal S_P and the negative signal N_P to a circuit unit 250. The circuit unit 250 of FIG. 5A may correspond to the first defect detector 162 or the second defect detector 164 of FIG. 4. The circuit unit 250 may include a first AND gate 252, a second AND gate 254, and a NOT gate 255. The first AND gate 252 may perform a logical conjunction of the positive signal S_P and the enable signal EN. The second AND gate 254 may perform the logical conjunction of the negative signal S_N and the enable signal EN. The NOT gate 255 may inverse an output signal of the second AND gate 254. Referring to FIG. 5C, the circuit unit 250 may output the positive signal S_P and the negative signal S_N provided from the timing controller 200 as a positive output signal Out_P and a negative output signal Out_N, respectively, when the enable signal EN having the first level is provided to the circuit unit 250. The positive output signal Out_P and the negative output signal Out_N may be provided to the data driver. The defect detecting image may be displayed on the display panel. Here, the defect detecting image may be a predetermined test image for detecting the defect of the data driver. In an exemplary embodiment, for example, the defect detecting image may be a white color image. On the other hand, the circuit unit 250 may output the positive signal S_P provided from the timing controller 200 as the positive output signal Out_P having the second level and output the negative signal S_N provided from the timing controller 200 as the negative output signal Out_N having the first level when the enable signal EN having the second level is provided to the circuit unit 250. The positive output signal Out_P having the second level and the negative signal S_N having the first level may be provided to the data driver. In this case, the display may display a black color image on the display panel. Here, the black color image may be the reference image that allows the defect on the defect detecting image to be easily detected by contrasting color difference from the color of the defect detecting image, for example.

Referring to FIG. 5B, a timing controller 300 may provide the differential signal that includes the positive signal S_P and the negative signal S_N to the circuit unit 350. The circuit unit 350 of FIG. 5B may correspond to the first defect detector or the second defect detector of FIG. 4. The circuit unit 350 may include a first multiplexer 352 and the second multiplexer 354. The first multiplexer 352 may output one of the positive signal and a first voltage Vss based on the enable signal EN. Here, the first voltage Vss may be the voltage having the second level. The second multiplexer 354 may output one of the negative signal S_N and a second voltage Vdd based on the enable signal EN. Here, the second voltage Vdd may be the voltage having the first level. Referring to FIG. 5C, the circuit unit 350 may output the positive signal S_P and the negative signal S_N provided from the timing controller 300 as the positive output signal Out_P and the negative output signal Out_N, respectively, when the enable signal EN having the first level is provided to the circuit unit 350. That is, the first multiplexer 352 may output the positive signal S_P as the positive output signal Out_P among the positive signal S_P and the first voltage Vss, and the second multiplexer 354 may output the negative signal S_N as the negative output signal Out-N among the negative signal S_N and the second voltage Vdd when the enable signal having the first level is provided to the circuit unit 350. The positive output signal Out_P and the negative output signal Out_N may be provided to the data driver. The defect detecting image may be displayed on the display panel. Here, the defect detecting image may be a predetermined test image for detecting the defect of the data driver. In an exemplary embodiment, for example, the defect detecting image may be a white color image. On the other hand, the circuit unit 350 may output the positive output signal Out_P having the second level and the negative output signal Out_N having the first level when the enable signal EN having the second level is provided to the circuit unit 350. That is, the first multiplexer 352 may output the first voltage Vss having the second level among the positive signal S_P and the first voltage Vss, and the second multiplexer 354 may output the second voltage Vdd having the first level among the negative signal S_N and the second voltage Vdd. The positive output signal Out_P having the second level and the negative output signal Out_N having the first level may be provided to the data driver. In this case, the display may display the black color image on the display panel. Here, the black color image may be the reference image that allows the defect on the defect detecting image to be easily detected.

Figure 7:
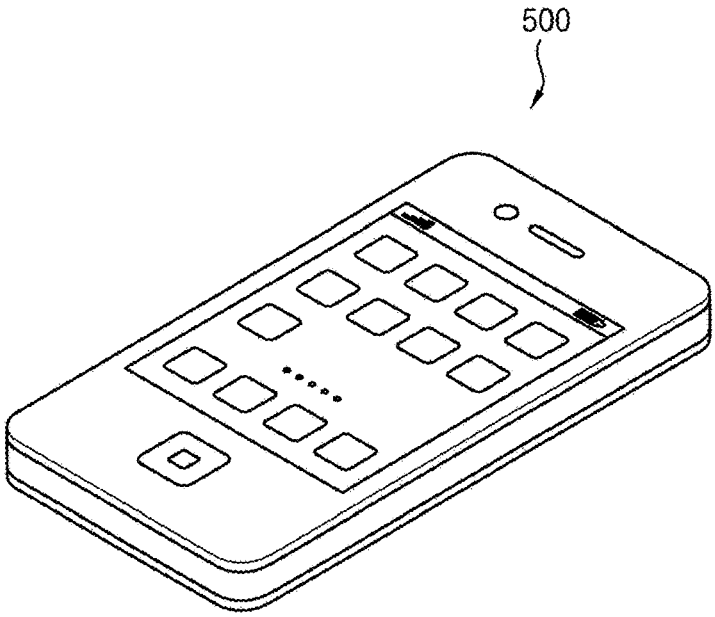
FIG. 7 is a diagram illustrating an exemplary embodiment in which the electronic device of FIG. 6 is implemented as a smart phone.

FIG. 6 is a block diagram illustrating an exemplary embodiment of an electronic device that includes the display device of FIG. 1, and FIG. 7 is a diagram illustrating an exemplary embodiment in which the electronic device of FIG. 6 is implemented as a smart phone.

Referring to FIGS. 6 and 7, an electronic device 400 may include a processor 410, a memory device 420, a storage device 430, an input/output ("I/O") device 440, a power device 450, and a display device 460. Here, the display device 460 may correspond to the display device 100 of FIG. 1. In addition, the electronic device 400 may further include a plurality of ports for communicating a video card, a sound card, a memory card, a universal serial bus ("USB") device, other electronic device, etc. Although it is illustrated in FIG. 7 that the electronic device 400 is implemented as a smart phone 500, the kind of the electronic device 400 according to the invention is not limited thereto.

The processor 410 may perform various computing functions. The processor 410 may be a micro processor, a central processing unit ("CPU"), etc. The processor 410 may be coupled to other components via an address bus, a control bus, a data bus, etc. Further, the processor 410 may be coupled to an extended bus such as surrounded component interconnect ("PCI") bus. The memory device 420 may store data for operations of the electronic device 400. In an exemplary embodiment, for example, the memory device 420 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory (PoRAM) device, a magnetic random access memory ("MRAM") device, a ferroelectric random access memory ("FRAM") device, etc, and/or at least one volatile memory device such as a dynamic random access memory ("DRAM") device, a static random access memory ("SRAM") device, a mobile DRAM device, etc. The storage device 430 may be a solid stage drive ("SSD") device, a hard disk drive ("HDD") device, a CD-ROM device, etc.

The I/O device 440 may be an input device such as a keyboard, a keypad, a touchpad, a touch-screen, a mouse, etc, and an output device such as a printer, a speaker, etc. In some exemplary embodiments, the display device 460 may be included in the I/O device 440. The power device 450 may provide a power for operations of the electronic device 400. The display device 460 may communicate with other components via the buses or other communication links. As described above, the display device 460 may include a display panel, a first data driver, a second data driver, a gate driver, a timing controller, and a defect detector. The display panel may include data lines, gate lines, and a plurality of pixels. The display panel may include a first display area and a second display area. A first data signal from the first data driver may be provided to the first display area through the data line. A second data signal from the second data driver may be provided to the second display area through the data line. The first data driver may provide the first data signal through the data lines in the first display area. The second data driver may provide the second data signal through the data line in the second display area. The first data driver and the second data driver may be directly mounted on the display panel or be coupled to the display panel as a TCP. The gate driver may provide a gate signal to the display panel through the gate lines. The timing controller may generate control signals that control the first data driver, the second data driver, and the gate driver. The timing controller may receive a first image data and an input control signal from an external device. The timing controller may provide the second image data to the defect detector. The timing controller may provide the second image data corresponding to the defect detecting image that will be displayed on the display panel in a defect detecting mode of the display device. Here, the defect detecting image may be predetermined to detect the defect on the first display area or the second display area. The defect detector may display an image on the first display area and the second display area based on an enable signal. The defect detector may alternatively display the defect detecting image and a reference image on the first display area and the second display area based on the enable signal and detect the defect of each of the first data driver and the second data driver based on the defect detecting image. As described above, the electronic device 400 of FIG. 6 may respectively detect the defect of the first data driver coupled to the first display area and the second data driver coupled to the second display area by the display device 460 that alternately display the defect detecting image and the reference image on the first display area and the second display area.

Figure 8:
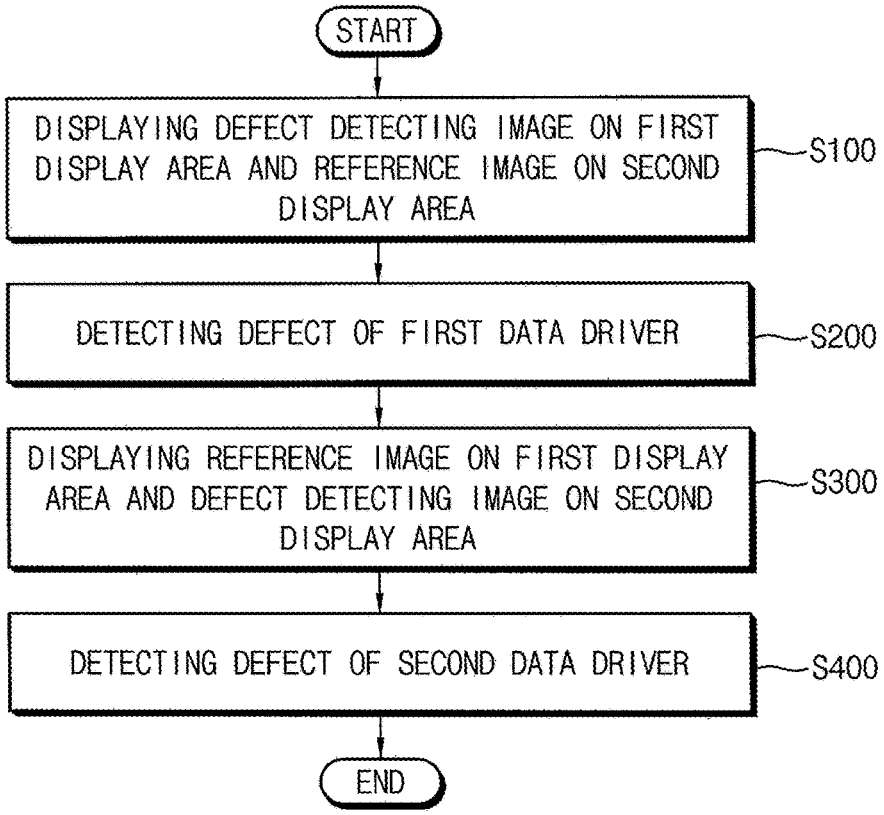
FIG. 8 is a flowchart illustrating an exemplary embodiment of a method of detecting defect of a display device according to the invention.
Figure 9:
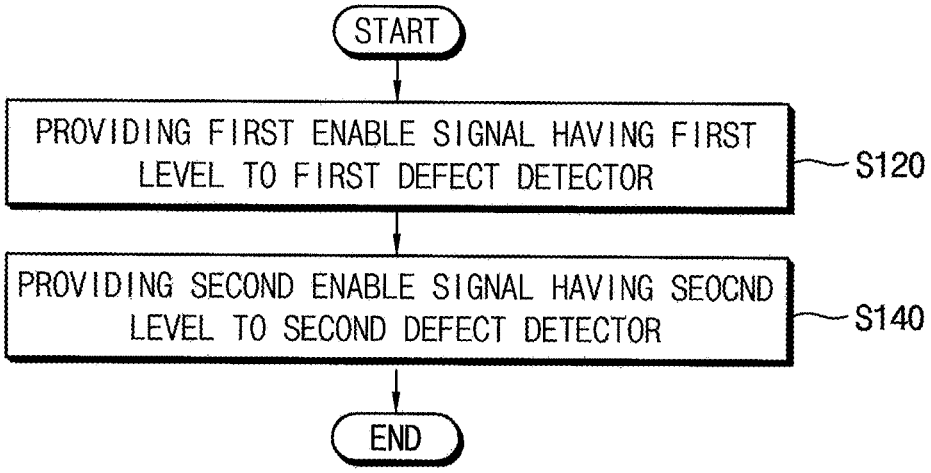
FIGS. 9 and 10 are flowcharts illustrating an exemplary embodiment of a method of displaying a defect detecting image included in the method of detecting defect of the display device of FIG. 8.
Figure 10:
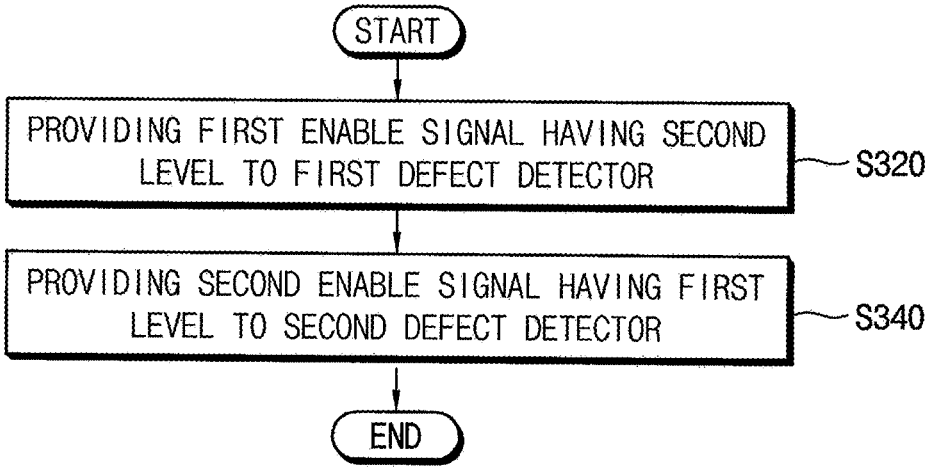
Figure 11A:
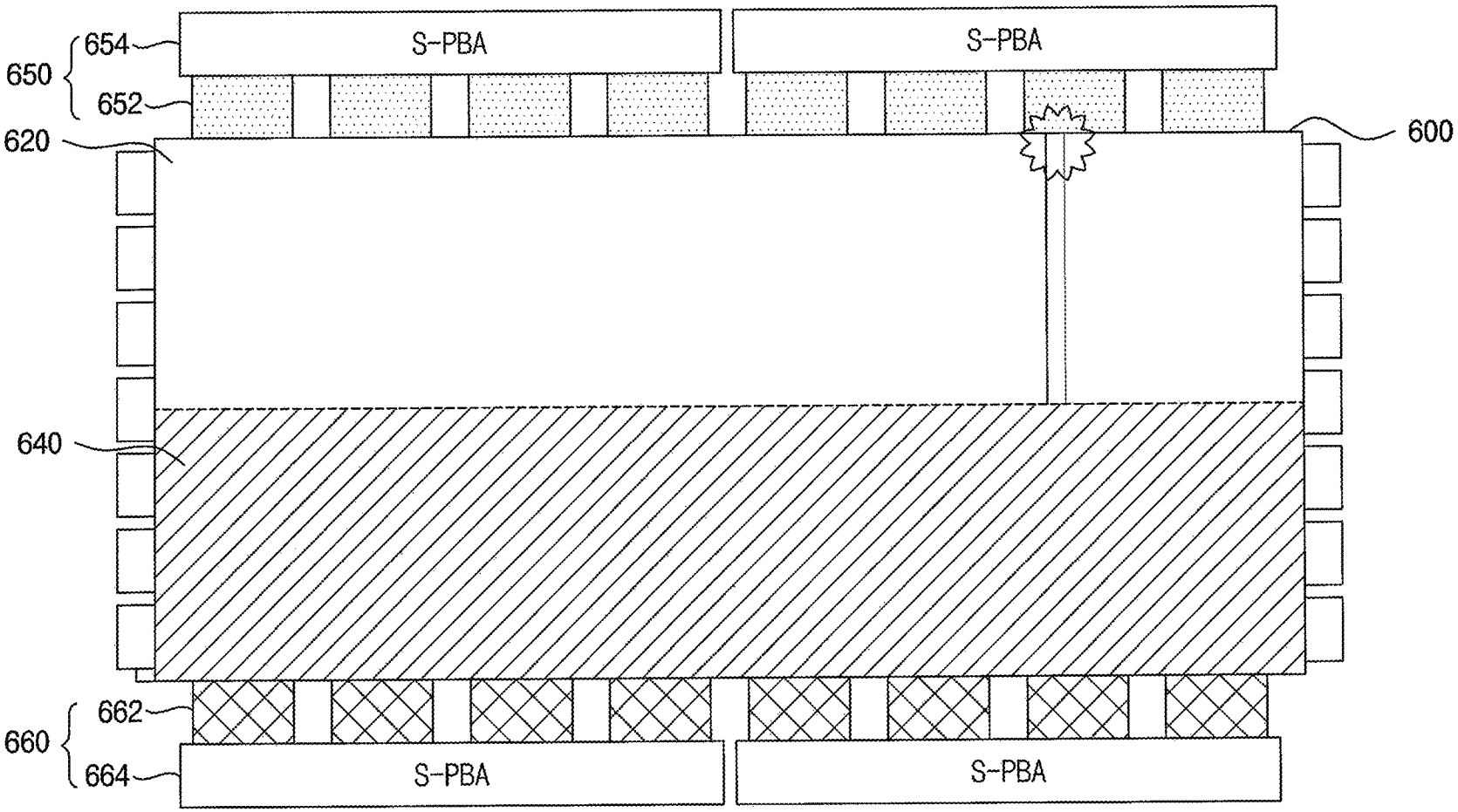
FIGS. 11A and 11B are diagrams for describing the method of detecting defect of the display device of FIG. 8.
Figure 11B:
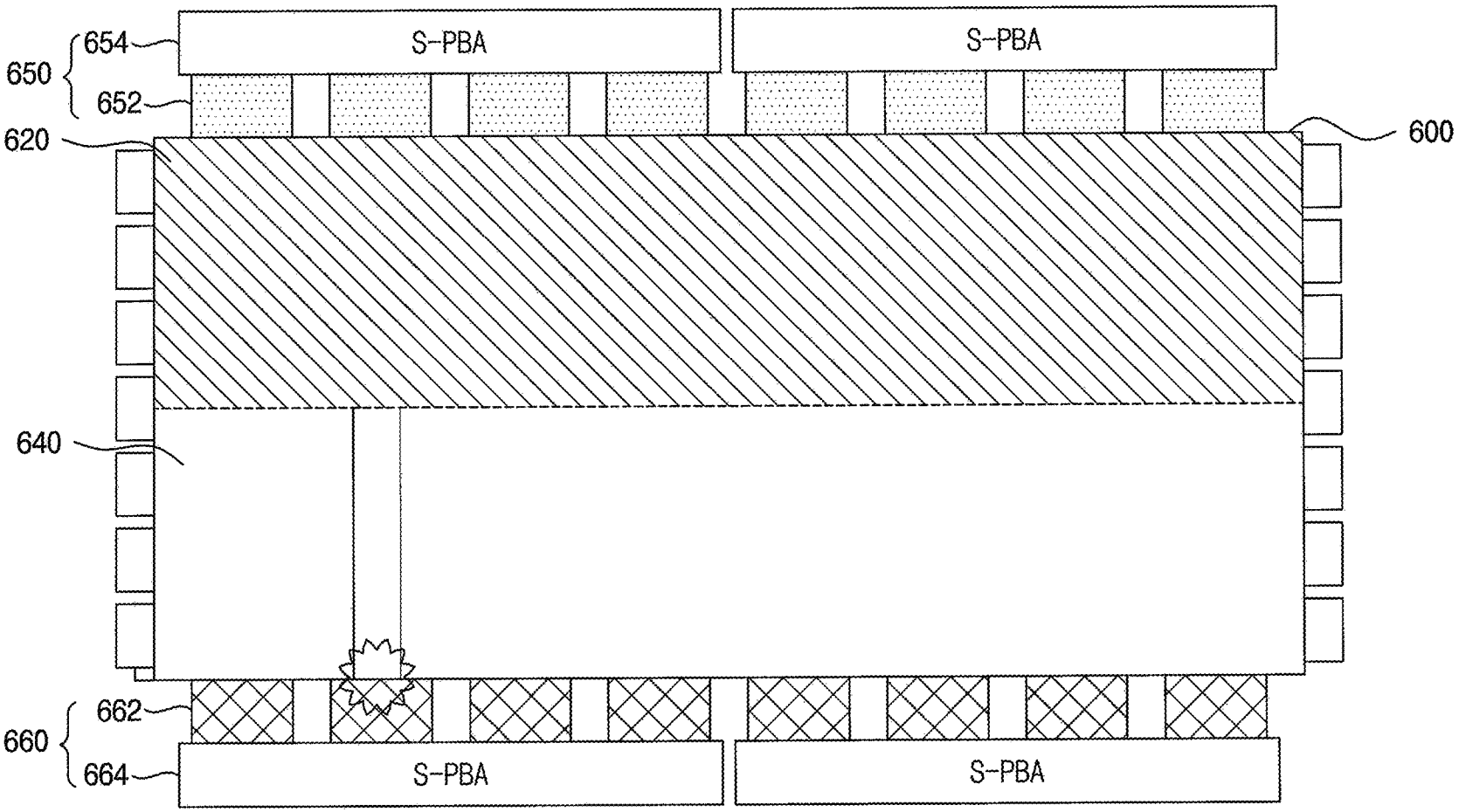

FIG. 8 is a flowchart illustrating an exemplary embodiment of a method of detecting defect of a display device according to the invention. FIGS. 9 and 10 are flowcharts illustrating an exemplary embodiment of a method of displaying a defect detecting image included in the method of detecting defect of the display device of FIG. 8. FIGS. 11A and 11B are diagrams for describing the method of detecting defect of the display device of FIG. 8.

Referring to FIG. 8, a method of detecting defect of a display device may include displaying a defect detecting image on a first display area and a reference image on a second display area (S100), detecting a defect on the first data driver (S200), displaying the reference image on the first display area and the defect detecting image on the second display area (S300), and detecting a defect on the second data driver (S400).

The method of detecting defect of the display device may display the defect detecting image on the first display area and display the reference image on the second display area (S100). Referring to FIG. 9, displaying the defect detecting image on the first display area and the reference image on the second display area (S100) may include providing a first enable signal having a first level to a first defect detector (S120) and providing a second enable signal having a second level to a second defect detector (S140).

Referring to FIG. 11A, a first data driver 650 may include first source driving integrated circuits 652 and first source connecting circuits 654. The first defect detector (not illustrated) may be coupled to the first data driver 650 including the first source driving integrated circuits 652 and the first source connecting circuits 654 that provides the data signal. The defect detecting image data provided from the timing controller may be provided to the first data driver 650 when the first enable signal having the first level is provided to the first defect detector. Thus, the defect detecting image for detecting the defect may be displayed on the first display area 620 of the display panel 600. The defect detecting image may be an image for detecting the defect of the first source driving integrated circuit 652. In an exemplary embodiment, for example, the defect detecting image may be a white color image, a red color image, a green color image, a blue color image, etc. The second data driver 660 may include second source driving integrated circuit 662 and second source connecting circuits 664. The second defect detector (not illustrated) may be coupled to the second data driver 660 including the second source driving integrated circuit 662 and the second source connecting circuits 664 that provides the data signal. The reference image data may be provided to the second data driver 660 when the second enable signal having the second level is provided to the second defect detector. In an exemplary embodiment, for example, the second defect detector may convert the defect detecting image data provided from the timing controller to the reference image data. Alternatively, the second defect detector may store the reference image data. Thus, the reference image that allows the defect of the first display area 620 to be easily detected may be displayed on the second display area 640 of the display panel 600. In an exemplary embodiment, for example, the reference image may be the black color image.

The method of detecting defect of the display device may detect the defect of the first data driver (S200). The defect detecting image may be displayed on the first display area and the reference image may be displayed on the second display area. An inspector or a user may detect the defect on the first display area and may detect at least one of the source driving integrated circuits on which the defect occurs.

The method of detecting defect of the display device may display the reference image on the first display area and the defect detecting image on the second display area (S300). Referring to FIG. 10, displaying the reference image on the first display area and the defect detecting image on second display area (S300) may include providing the first enable signal having the second level to the first defect detector (S320), and providing the second enable signal having the first level to the second defect detector (S340).

Referring to FIG. 11B, the first defect detector may be coupled to the first data driver 650 including the first source driving integrated circuits 652 and the first source connecting circuits 654, that provides the data signal. The reference image data may be provided to the data driver 650 when the first enable signal having the second level is provided to the first defect detector. In an exemplary embodiment, for example, the second defect detector may convert the defect detecting image data provided from the timing controller to the reference image data. Alternatively, the second defect detector may store the reference image data. Thus, the reference image that allows the defect of the second display area 640 to be easily detected may be displayed on the first display area 620 of the display panel 600. In an exemplary embodiment, for example, the reference image may be the black color image. The second defect detector may be coupled to the second data driver 660 including the second source driving integrated circuits 662 and the second source connecting circuits 664, that provides the data signal. The defect detecting image data provided from the timing controller may be provided to the second data driver 660 when the second enable signal having the first level is provided to the second defect detector. Thus, the defect detecting image for detecting the defect may be displayed on the second display area 640 of the display panel 600. The defect detecting image may be an image for detecting the defect of the second source driving integrated circuit 662. In an exemplary embodiment, for example, the defect detecting image may be a white color image, a red color image, a green color image, a blue color image, etc.

The method of detecting defect of the display device may detect the defect of the second data driver (S400). The reference image may be displayed on the first display area and the defect detecting image may be displayed on the second display area. An inspector or a user may detect the defect of the second display area and may detect at least one of the second source driving integrated circuits on which the defect occurs.

As described above, the method of detecting adefect of the display device may detect a defect of the first data driver coupled to the first display area and the second data driver coupled to the second display area respectively by alternately displaying the defect detecting image and the reference image on the first display area and the second display area.

Figure 12:
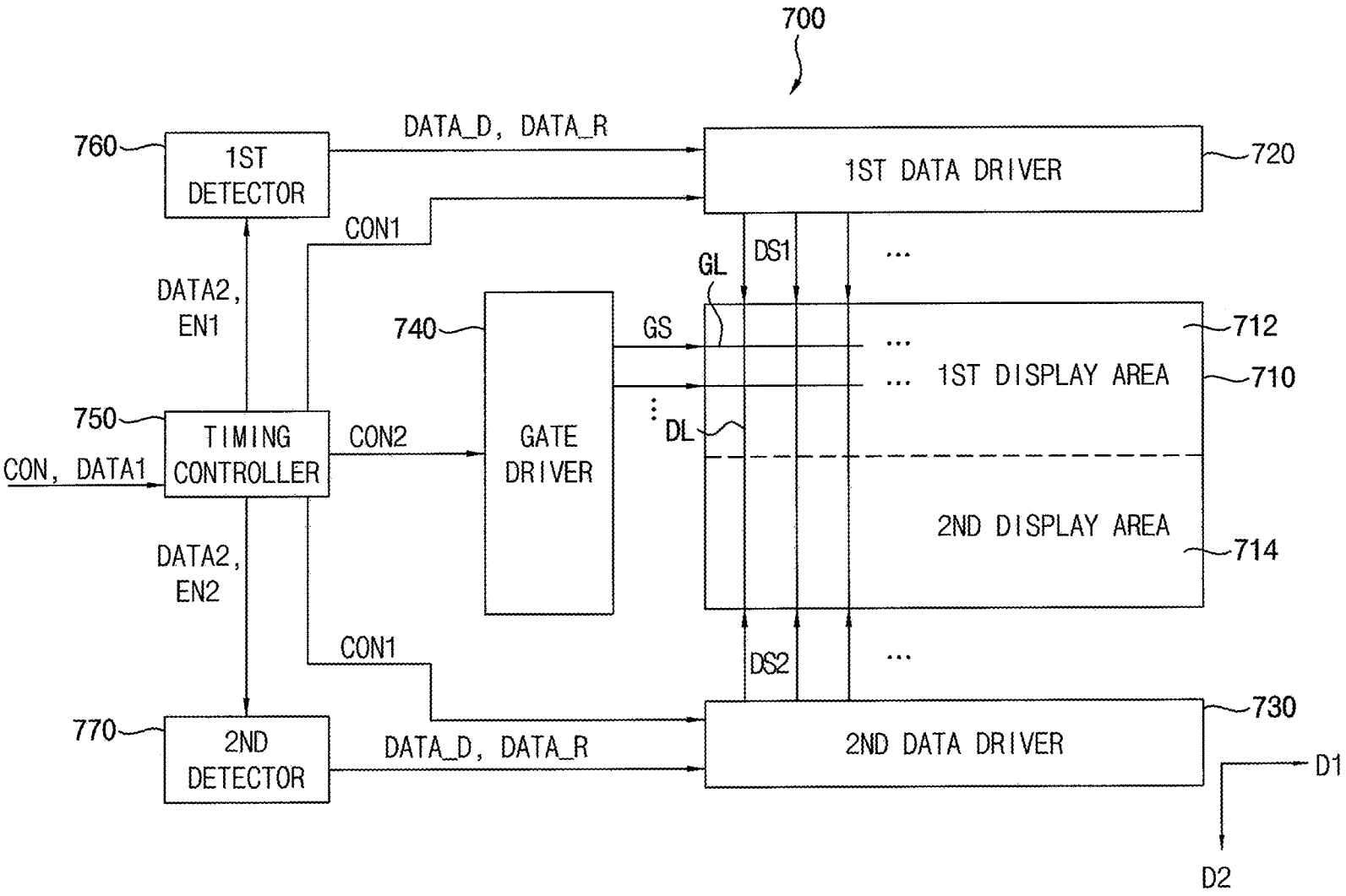
FIG. 12 is a block diagram illustrating another exemplary embodiment of a display device according to the invention.

FIG. 12 is a block diagram illustrating another exemplary embodiment of a display device according to the invention.

Referring to FIG. 12, a display device 700 may include a display panel 710, a first data driver 720, a second data driver 730, a gate driver 740, a timing controller 750, and a defect detector. The display panel 710 may include a first display area 712 and a second display area 714. The first data driver 720 may provide a first data signal DS1 to the first display area 712 through data lines DL of the display panel 710. The second data driver 730 may provide a second data signal DS2 to the second display area 714 through the data lines DL of the display panel 710. The gate driver 740 may provide gate signal GS to the first display area 712 and the second display area 714 through gate lines of the display panel 710. The timing controller 750 may generate control signals CON1 and CON2 that control the first data driver 720, the second data driver 730, and the gate driver 740. The timing controller 750 may receive a first image data DATA1 from an external device and provide a second image data DATA2 that is substantially the same as the first image data DATA1 or that is generated by compensating the first image data DATA1 to the defect detector. The timing controller 750 may provide a defect detecting image data DATA_D corresponding to the defect detecting image to the defect detector as the second image data DATA2 in a defect detecting mode.

The defect detector may include a first defect detector 760 and a second defect detector 770. The first defect detector 760 may provide the defect detecting image data DATA_D or a reference image data DATA_R to the first data driver 720 that provides the data signal to the first display area 712. The first defect detector 760 may provide the defect detecting image data DATA_D or the reference image data DATA_R to the first data driver 720 based on a first enable signal EN1 provided from the timing controller 750. The first defect detector 760 may provide the defect detecting image data DATA_D to the first data driver 720 coupled to the first display area 712 when the first enable signal EN having a first level is provided to the first defect detector 760. The first defect detector 760 may provide reference image data DATA_R to the first data driver 720 coupled to the first display area 712 when the first enable signal EN having a second level is provided to the first defect detector 760. The first defect detector 760 may generate the reference image data DATA_R by converting the defect detecting image data DATA_D provided from the timing controller 750 when the first enable signal EN1 having the second level is provided to the first defect detector 760. In another exemplary embodiment, the first defect detector 760 may store the reference image data DATA_R. The second defect detector 770 may provide the defect detecting image data DATA_D or the reference image data DATA_R to the second data driver 730 that provides the data signal to the second display area 714. The second defect detector 770 may provide the defect detecting image data DATA_D or the reference data DATA_R to the second data driver 730 based on a second enable signal EN2 provided from the timing controller 750. The second defect detector 770 may provide the defect detecting image data DATA_D to the second data driver 730 coupled to the second display area 714 when the second enable signal EN2 having the first level is provided to the second defect detector 770. The second defect detector 770 may provide the reference image data DATA_R to the second data driver 730 coupled to the second display area 714 when the second enable signal EN2 having the second level is provided to the second defect detector 770. The second defect detector 770 may generate the reference image data DATA_R by converting the defect detecting image data DATA_D provided from the timing controller 750 when the second enable signal EN2 having the second level is provided to the second defect detector 770. In another exemplary embodiment, the second defect detector 770 may store the reference image data DATA_R.

The timing controller 750 may provide the first enable signal EN1 having the first level to the first defect detector 760 and the second enable signal EN2 having the second level to the second defect detector 770. In this case, the first defect detector 760 may provide the defect detecting image data DATA_D to the first data driver 720 and the second defect detector 770 may provide the reference image data DATA_R to the second data driver 730. Thus, the defect detecting image may be displayed on the first display area 712 and the reference image may be displayed on the second display area 714. Here, the defect detecting image may be predetermined for detecting the defect on the first display area 712, and the reference image may be predetermined for easily detecting the defect on the first display area 712. In another exemplary embodiment, for example, the defect detecting image may be one of a white color image, a red color image, a green color image, and a blue color image, and the reference image may be a black color image. Thus, the defect on the first display area 712 and the defect of the first data driver 720 may be detected.

The timing controller 750 may provide the first enable signal EN1 having the second level to the first defect detector 760 and the second enable signal EN2 having the first level to the second defect detector 770. In this case, the first defect detector 760 may provide the reference image data DATA_R to the first data driver 720, and the second defect detector 770 may provide the defect detecting image data DATA_D to the second data driver 730. Thus, the reference image may be displayed on the first display area 712 and the defect detecting image may be displayed on the second display area 714. Therefore, the defect on the second display 714 and the defect of the second data driver 730 may be detected.

As described above, in the display device 700 of which the data signal is provided to both ends of the display panel 710, the display device 700 may detect defects of the first data driver 720 coupled to the first display area 712 and the second data driver 740 coupled to the second display area 714 respectively by including a first defect detector 760 and the second defect detector 770 that control to display the defect detecting image and the reference image alternately on the first display area 712 and the second display area 714 of the display panel 710.

The inventive concept may be applied to a display device and an electronic device having the display device. For example, the inventive concept may be applied to a computer monitor, a laptop, a digital camera, a cellular phone, a smart phone, a smart pad, a television, a personal digital assistant ("PDA"), a portable multimedia player ("PMP"), a MP3 player, a navigation system, a game console, a video phone, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A display device comprising:

a display panel divided into a first display area and a second display area in a first direction;

a first data driver which provides a first data signal to the first display area through data lines arranged in a second direction crossing the first direction;

a second data driver which provides a second data signal to the second display area through the data lines arranged in the second direction;

a gate driver which provides a gate signal to the display panel through gate lines arranged in the first direction;

a timing controller which generates control signals that control the first data driver, the second data driver, and the gate driver; and a defect detector which controls to display a defect detecting image and a reference image on the first display area and the second display area alternately based on an enable signal to detect a defect of at least one of the first data driver and the second data driver.

2. The display device of claim 1, wherein the timing controller provides defect detecting image data corresponding to the defect detecting image to the defect detector, and wherein the defect detector provides the defect detecting image data or reference image data corresponding to the reference image to the first data driver or the second data driver based on the enable signal.

3. The display device of claim 1, wherein the defect detector includes:

a first defect detector which provides defect detecting image data corresponding to the defect detecting image or reference image data corresponding to the reference image to the first data driver based on a first enable signal; and a second defect detector which provides the defect image data or the reference image data to the second data driver based on a second enable signal.

4. The display device of claim 3, wherein the first defect detector controls to display the defect detecting image on the first display area for detecting the defect of the first data driver, and wherein the second defect detector controls to display the defect detecting image on the second display area for detecting the defect of the second data driver.

5. The display device of claim 3, wherein the first defect detector provides the defect detecting image data to the first data driver when the first enable signal having a first level is provided and provides the reference image data to the first data driver when the first enable signal having a second level is provided.

6. The display device of claim 3, wherein the second defect detector provides the defect detecting image data to the second data driver when the second enable signal having a first level is provided and provides the reference image data to the second data driver when the second enable signal having a second level is provided.

7. The display device of claim 3, wherein the defect detecting image is displayed on the first display area when the first enable signal having a first level is provided to the first defect detector, and wherein the reference image is displayed on the first display area when the first enable signal having a second level is provided to the first defect detector.

8. The display device of claim 3, wherein the defect detecting image is displayed on the second display area when the second enable signal having a first level is provided to the second defect detector, and wherein the reference image is displayed on the second display area when the second enable signal having a second level is provided to the second defect detector.

9. The display device of claim 3, wherein the first enable signal having a first level is provided to the first defect detector and the second enable signal having a second level is provided to the second defect detector in order to detect the defect of the first data driver.

10. The display device of claim 3, wherein the first enable signal having a second level is provided to the first defect detector and the second enable signal having a first level is provided to the second defect detector in order to detect the defect of the second data driver.

11. The display device of claim 3, wherein the defect detecting image data is a differential signal that includes a positive signal and a negative signal.

12. The display device of claim 11, wherein each of the first defect detector and the second defect detector includes:

a first AND gate which performs a logical conjunction of the positive signal and a corresponding enable signal of the first and second enable signals;

a second AND gate which performs a logical conjunction of the negative signal and the corresponding enable signal of the first and second enable signals; and a NOT gate which inverses an output of the second AND gate.

13. The display device of claim 11, wherein each of the first defect detector and the second defect detector includes:

a first multiplexer which outputs one of the positive signal and a first voltage based on a corresponding enable signal of the first and second enable signals; and a second multiplexer which outputs one of the negative signal and a second voltage.

14. The display device of claim 1, wherein the reference image is a black color image.

15. A method of detecting defect of a display device comprising:

displaying a defect detecting image on a first display area of a display panel and a reference image on a second display area of the display panel, wherein the display panel is divided into the first display area and the second display area in a direction;

detecting a defect of a first data driver coupled to the first display area;

displaying the reference image on the first display area and the defect detecting image on the second display area; and detecting a defect of a second data driver coupled to the second display area, wherein a defect of at least one of the first data driver and the second data driver is detected by alternately displaying the defect detecting image and the reference image on the first display area and the second display area.

16. The method of claim 15, wherein displaying the defect detecting image on the first display area and the reference image on the second display area includes:

providing a first enable signal having a first level to a first defect detector coupled to the first data driver that provides a data signal to the first display area; and providing a second enable signal having a second level to a second defect detector coupled to the second data driver that provides a data signal to the second display area.

17. The method of claim 15, wherein displaying the reference image on the first display area and the defect detecting image on the second display area includes:

providing a first enable signal having a second level to a first defect detector coupled to the first data driver that provides a data signal to the first display area; and providing a second enable signal having a first level to a second defect detector coupled to the second data driver that provides a data signal to the second display area.

18. A display device comprising:

a display panel which includes a first display area and a second display area; and a defect detector which controls a first data driver to display a defect detecting image or a reference image on the first display area based on a first enable signal and controls a second data driver to display a defect detecting image or a reference image on the second display area based on a second enable signal, wherein the reference image is displayed on the second display area when the defect detecting image is displayed on the first display area, and the defect detecting image is displayed on the second display area when the reference image is displayed on the first display area, and wherein a defect of at least one of the first data driver and the second data driver is detected by alternately displaying the defect detecting image and the reference image on the first display area and the second display area.

19. The display device of claim 18, wherein the defect detector includes:

a first defect detector which provides defect detecting image data corresponding to the defect detecting image or reference image data corresponding to the reference image to a first data driver that provides a data signal to the first display area; and a second defect detector which provides the defect detecting image data or the reference image data to a second data driver that provides a data signal to the second display area.

20. The display device of claim 19, wherein the first defect detector provides the defect detecting image data to the first data driver when the first enable signal having a first level is provided and provides the reference image data to the first data driver when the first enable signal having a second level is provided, and wherein the second defect detector provides the defect detecting image data to the second data driver when the second enable signal having the first level is provided and provides the reference image data to the second data driver when the second enable signal having the second level is provided.

* * * * *